United States Patent [19]

Zehnder, Jr.

[11] Patent Number: 4,999,611

[45] **Date of Patent: * Mar. 12, 1991**

[54] TOWEL CABINET REPLENISHMENT INDICATION AND IDENTIFICATION SYSTEM

[76] Inventor: William Zehnder, Jr., 713 S. Main St., Frankenmuth, Mich. 48734

[ * ] Notice: The portion of the term of this patent subsequent to May 24, 2005 has been disclaimed.

[21] Appl. No.: 164,186

[22] Filed: Mar. 4, 1988

Related U.S. Application Data

[63] Continuation of Ser. No. 789,407, Oct. 21, 1983, Pat. No. 4,746,907.

[51] Int. Cl.[5] ..... G08B 13/14

[52] U.S. Cl. ..... 340/568; 312/38; 340/525

[58] Field of Search ..... 340/568, 675, 525, 524; 200/61.13-61.18; 312/38; 242/55.53, 186

[56] References Cited

U.S. PATENT DOCUMENTS

| | | | |
|---|---|---|---|
| 1,756,822 | 4/1930 | Hails | 312/38 |
| 1,988,266 | 1/1935 | De Bersaques | 312/38 |
| 2,103,403 | 12/1937 | Birr | 312/38 |
| 2,685,895 | 8/1954 | Turner | 200/61.16 X |
| 4,167,322 | 9/1979 | Yano et al. | 340/524 X |
| 4,294,065 | 10/1981 | Lane | 340/525 X |
| 4,549,170 | 10/1985 | Serres et al. | 340/568 |
| 4,746,907 | 5/1988 | Zehnder, Jr. | 340/525 |

*Primary Examiner*—Glen R. Swann, III
*Assistant Examiner*—Thomas J. Mullen, Jr.
*Attorney, Agent, or Firm*—Learman & McCulloch

[57] ABSTRACT

The system indicates which of a plurality of dispersed towel cabinets in a building have their clean towel webs soiled, and require towel roll replacement. A clean toweling supply roller system is mounted within each of the cabinets for web unwinding rotary travel, and a used toweling wind-up roller system is also mounted within each of the cabinets for rewinding the soiled web as it is used. The supply roller system in each cabinet includes an axially extending dispensing roller with an electrically conductive, annular strip on its peripheral face, and a matching strip is provided on a second member which is normally separated from the strip on the roller by the web, and which, when the terminal end of the towel web is withdrawn, electrically engages therewith. A multiple indicator system is electrically connected with the respective strips in each cabinet, and is energized by the electrical engagement of the matching strips in a given cabinet to activate an indicator which identifies which cabinet requires towel replenishment.

9 Claims, 2 Drawing Sheets

TOWEL CABINET REPLENISHMENT INDICATION AND IDENTIFICATION SYSTEM

This is a continuation of co-pending application Ser. No. 789,407 filed on Oct. 21, 1985, now U.S. Pat. No. 4,746,907.

BACKGROUND OF THE INVENTION

The present invention relates to towel cabinets of the type used in public bathrooms, and more particularly the type of cabinet in which the toweling is withdrawn from a supply roll in the cabinet, and forms a dependent loop within the reach of the user drying his or her hands, prior to returning back into the cabinet to a wind-up roll. While generally such cabinets are manually operated, in that the user pulls the length of toweling downwardly in increments as required, and this downward pull is also utilized to return the soiled length of towel to the wind-up roller in the cabinet, it is believed the invention to be disclosed herein is also useful with motor driven toweling rolls.

DESCRIPTION OF THE PRIOR ART

In larger buildings having a considerable number of bathrooms and cabinets, good, sanitary practice requires the replacement of toweling, when the roll has been completely soiled, without delay. Cabinets of the type with which the present invention may be utilized are disclosed in some of the following U. S. patents:

| | |
|---|---|
| 1,756,822 Hails | 3,951,485 Schnyder et al |
| 1,988,266 De Bersaques | 3,971,607 Schnyder |
| 2,103,403 Birr | 4,270,818 McCabe |
| 3,920,294 Kullik | |

It has been the practice in large establishments, such as restaurants, for the building custodian to be responsible for monitoring the condition of the towel cabinets in the bathrooms. The difficulty of adequately performing this task, as well as accomplishing other custodial duties, is greatly compounded when the building is large, and the bathrooms are on different floors, and widely separated from one another. While it has been suggested that such cabinets have a visual indicator for indicating when the supply of fresh toweling is near depletion, or depleted, such devices have not solved the problem, because they require on-site inspection.

SUMMARY OF THE INVENTION

The present invention is concerned with an indicating and identifying system, wherein a centrally located, multiple-cabinet system is electrically energized by circuit-making elements within each cabinet, which are mounted in confronting relation on one of the dispensing rollers, and on a second member which is normally separated from the roller by the toweling web being dispensed. The system employs a number of lamps, or other indicating devices, which are individually identified so that when the terminal end of the toweling in a particular cabinet is pulled free, strip contacts, which ordinarily are held out of engagement only by the toweling, make a circuit which energizes the indicator identifying the particular cabinet as requiring towel web replenishment.

One of the prime objects of the present invention is to provide a central system which can be monitored by one of a number of parties normally working in an area, such as the kitchen, who will be apprised instantly when a particular cabinet in a particular bathroom requires clean toweling.

A further object of the invention is to provide a system which is readily adaptable to the cabinets in commercial use today, and can be simply and economically installed by technicians who require no special expertise.

Another object of the invention is to provide a highly reliable system of the character described which does not require the addition of expensive and complex components to existing towel cabinets.

Other objects and advantages of the invention will become apparent with reference to the accompanying drawings.

IN THE DRAWINGS

Figure 1:
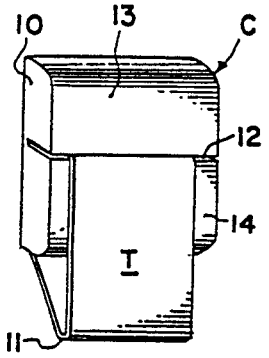
FIG. 1 is a perspective, front elevational view, of a typical cabinet.

Referring now more particularly to the accompanying drawings, cabinets of the type to be described here are generally described in prior U.S. Pat. No. 1,988,266 and 2,103,403, both of which are incorporated by reference herein. The cabinet C illustrated in FIG. 1, may be considered to be of the type which has a pair of side walls 10, fixed to a rear wall which is adapted to be secured to the wall of the room in which the cabinet C is used, at a suitable height which provides access to the loop 11 of toweling T. The toweling T depends from a slot 12 in the front of the cabinet, provided between an upwardly swingable, lockable upper front wall section 13, and a downwardly swingable, lockable, lower front wall section 14. It is to be understood that wall 13 is pivotally mounted to swing upwardly about pivots 13*a* to provide access to a roller 15 and the supply of soiled toweling wound thereon, and the front wall portion 14 is pivotally mounted, as at 14*a*, so that it can be swung down to permit replenishment of a fresh towel roll 16, when necessary.

Figure 3:
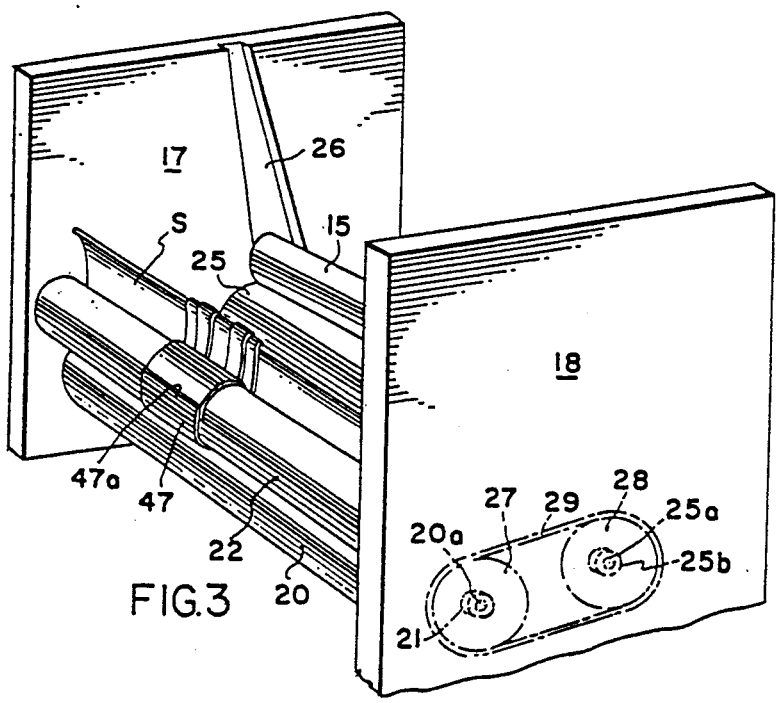
FIG. 3 is a schematic, perspective, combined side and front elevational view showing the soiled toweling shield swung up to a vertical position removed from the dispensing pinch roll, the toweling being omitted from this view in the interests of clarity.
Figure 4:
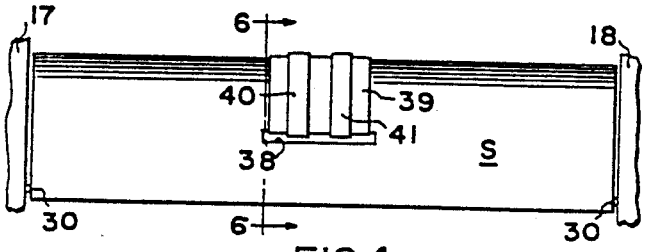
FIG. 4 is an enlarged, front elevational view of the shield only.

Secured within the cabinet C to side walls 10, as indicated in FIG. 3, are a pair of side plates 17 and 18, for supporting the various operating components. For instance, there is a clean towel supply roller system, generally designated 19, which includes a roller 20 with pin or shaft ends 20*a*, received in suitable bearings 21 carried by the walls 17 and 18. Also provided is a dispensing pinch roller 22, having slide bars 22*a* (FIG. 2) at its opposite ends which are mounted in open ended slide tracks 23. Mounted in spaced relation to the roller 20, which is a rough-surfaced roller, covered from end-to-end around its periphery with emery paper, is a curvilinear guide G around which the toweling web is drawn, prior to passing between roller 20 and the roller 22. The roller 22 is a non-conductive smooth-surfaced roller, and bears under the influence of the forces of gravity against the toweling web T and roller 20.

Figure 2:
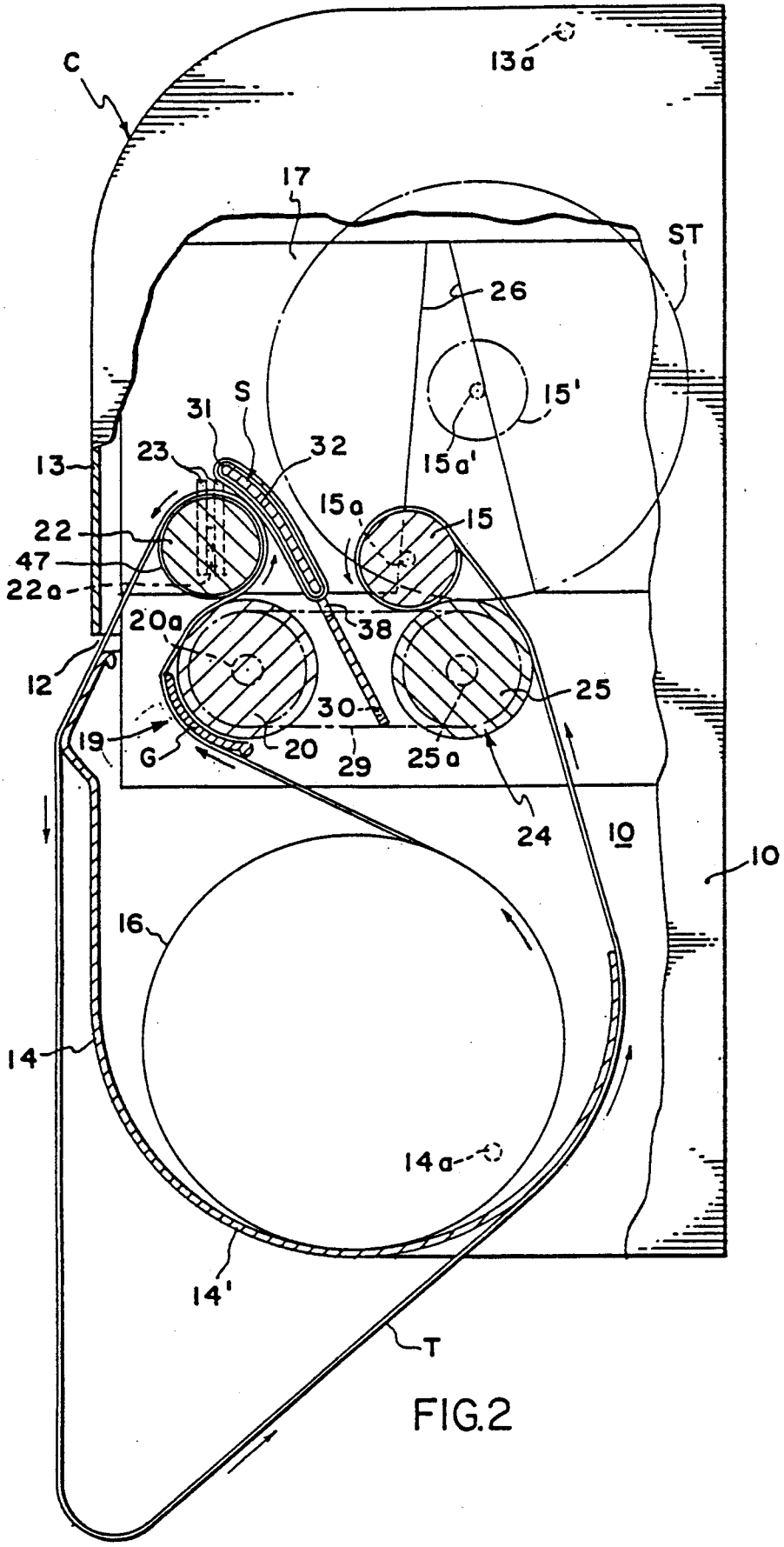
FIG 2 is a schematic, partly sectional, side elevational view illustrating certain of the operating components.

As particularly shown in FIG. 2, roller 15 is one component of a used towel wind-up roller system, generally designated 24, and including, also, a wind-up roller 25 which, like the roller 20, is covered from end to end around its periphery with emery paper and presents a rough surface to the toweling web T. The roller 25 has pin or shaft ends 25*a*, mounted by bearings 25*b*. Roller 15 has pin or shaft ends 15*a*, which are received within upwardly diverging slots 26, provided in the walls 17 and 18 so that the roller 15 can travel upwardly, away from wind-up roller 25, as the supply of toweling T is wound on it, to the position, for instance, shown at 15′ in which a considerable roll of soiled toweling ST has been wound thereon. The pin ends, in this position, are shown at 15*a*′ in engagement with the opposite walls of slots 26.

As FIG. 3 indicates, the pin ends 20*a* and 25*a* extend beyond the bearings 21 and 25*b* at one side, and mount sprockets 27 and 28 thereon respectively. A chain 29 is trained around sprockets 27 and 28, such that rotation of roller 20 causes like rotation of the equal diameter roller 25, and an equal length of toweling web is rewound for every length of toweling web paid out by the rollers 20 and 22.

Journaled by walls 17 and 18, as with pins 30, disposed in suitable bores provided in the wall 17 and 18 at a level below the axes of pin or shaft ends 20*a* and 25*a*, is a shield or partition, generally designated S, which extends to a level approximating the lower peripheries of rollers 20 and 15, and separates the web supply roller system from the soiled web roller system. The shield S comprises simply a metal plate which is curved at its upper end as at 31, so as to have a surface at 32 which substantially conforms, or is matched to, the periphery of roller 22. The shield S, in operative position, is pivoted as at 30 to walls 17 and 18 and gravity biased to rest against the toweling T and roller 22, as shown in FIG. 2.

Figure 5:
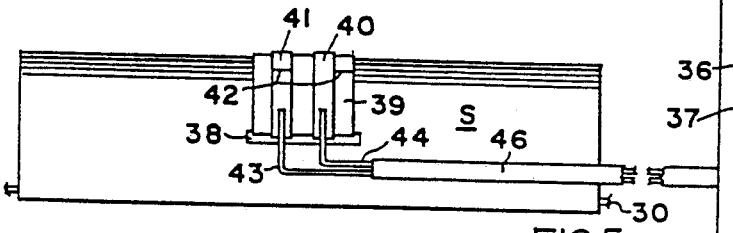
FIG. 5 is a rear elevational view of the shield, and shows it electrically connected to a central indicating lamp bank or panel.
Figure 6:
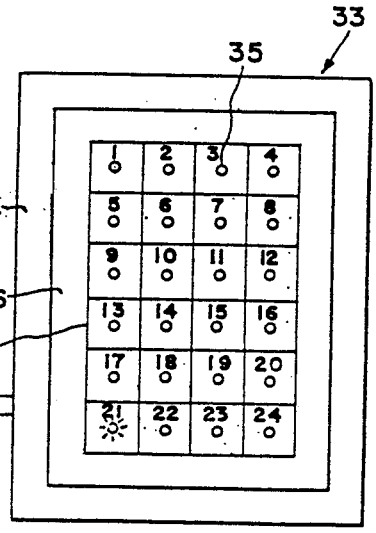
FIG. 6 is an enlarged sectional view, taken on the line 6—6 of FIG. 4.
Figure 6:
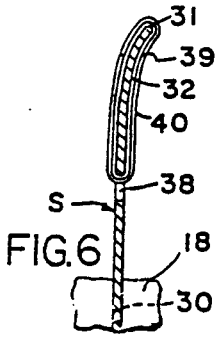
Figure 7:
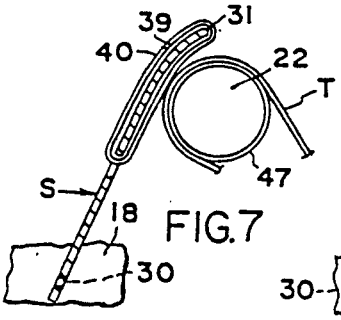
FIG. 7 is a similar view showing the shield swung down to the dispensing pinch roll to engage the web of toweling passing thereover.

As FIG. 5 schematically indicates, provided in a central location in the building, is a panel or bank of indicator lamps or other signal devices, generally indicated 33. The panel can comprise a frame 34, with the usual electrical sockets and connections for a series of individual lamps or bulbs 35, which are electrically connected in parallel with a power source. The panel may be typically of a type having a transparent front pane 36, which has a grid 37 imprinted thereon, with squares which are numbered as shown, in sequence. Each of the numbered squares is individual to one of the lamps 35, and the numbering system corresponds to cabinets in designated locations, so that, when a lamp is lit, a person monitoring the system will know instantly the location of the cabinet which caused the energization of that particular lamp.

The electrical strip system for energizing each of the lamps 35, is particularly disclosed in FIGS. 4–8, and is identical for each of the cabinets in the system, such that a description of the elements in one cabinet, will suffice for all. To ready a particular cabinet for inclusion in the system, an axially extending slot 38 is first cut through the shield S as shown. A length of electrically insulating flexible tape 39 is then inserted through the opening 38, and wrapped completely around the upper end of shield S. Then a pair of electrically conductive, bendable brass straps 40 and 41, about 1/64 to 1/32 inch in thickness, are inserted through opening 38, and bent around in loop form, to conform to the curvature of shield S, the overlapping ends of strips 40 and 41 being soldered as at 42, so that a pair of continuous conductive loops are formed.

Lead wires 43 and 44 are then soldered to the rear of each of the loop strips 40 and 41, as shown in FIG. 5, and extend through a suitable insulating sleeve 46 to electrically connect to panel 33. The various circuits may be powered by the conventional current supplied to the building, via a suitable step-down transformer.

Provided opposite shield S, secured to the periphery of roller 22, is a length of flexible metal tape 47 which may, for instance, be an aluminumized tape. The tape 47 is of sufficient axial width to span the strips 40 and 41, but of a width a little less than the axial width of insulating tape 39, to prevent any possibility of arcing. The tape 47 has an adhesive backing which permits it to readily adhere to roller 22, and it extends completely around roller 22, the one end lapping and being adhesively secured to the other as at 47*a*.

THE OPERATION

In normal position, a towel supply in roll form 16 is housed by the curvilinear lower portion 14′ of wall 14, as shown in FIG. 2, and its leading end is drawn up around guide G, and between the rollers 20 and 22. It then passes around roller 22 and out the slotted opening 12. The shield S rests by gravity in the position shown in FIGS. 2, 7 and 8, with its configured brass loops 40 and 41 separated from the strip 47 on roller 22 by the web of toweling T, which effectively electrically insulates them therefrom.

The user pulls a length of toweling T downwardly in the manner indicated in U.S. Pat. No. 1,988,266, for instance, and obtains a limited withdrawal of the toweling T, there being a stop device (not shown) which limits withdrawal of the web and some kind of device, such as the dashpot device indicated in U.S. Pat. No. 1,988,266, which is provided to release the stop device after a measured time interval. The toweling web is, of course, at the same time rewound on roller 15, and the roll of soiled toweling thereon eventually grows in size to the diameter ST. Roller 15 is permitted to move upwardly in the slots 26 away from the roller 25, to accommodate this growth.

Figure 8:
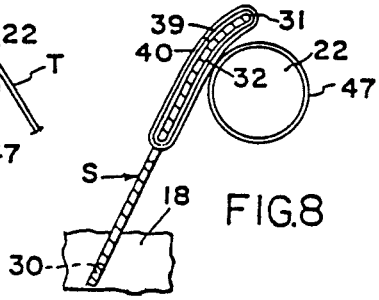
FIG. 8 is a similar view, with the shield now engaging the dispensing roller, as in a situation where the terminal end of the supply of toweling has been dispensed and the cabinet is in need of clean toweling replenishment.

Finally, when the toweling T has been completely dispensed and its terminal end withdrawn from between the roller 22 and the shield S, as shown in FIG. 8, a series circuit is made between the electrically separated loop strips 40 and 41, and the loop strip 47. Current, for instance, will pass from strip 40 to strip 47, and then to strip 41 to light one of the lamps 35. A party monitoring the panel 33 will know instantly that a particular cabinet in a particular bathroom needs fresh towel replenishment, and can immediately attend to it.

While one embodiment of the invention has been described in detail, it will be apparent to those skilled in the art that the disclosed embodiment may be modified.

Therefore, the foregoing description in all aspects is to be considered exemplary, rather than limiting in any way, and the true scope of the invention is that defined in the following claims.

What is claimed is:

1. A method of indicating which of a plurality of widely dispersed towel cabinets in a building have their clean toweling web completely soiled and require clean towel roll replacement, the cabinets each having a used toweling wind-up roller system within each cabinet for rewinding the soiled web therein, and a clean toweling supply roller system mounted within each of said cabinets for web unwinding, rotary travel, the supply roller system in each cabinet including an axially extending, electrically non-conductive roller and a second axially extending member normally separated from the roller by the web, comprising the steps of:

a. mounting an electrically conductive strip on the peripheral face of the roller curved to the configuration of the face;

b. mounting an electrically conductive strip on the said second member in confronting relation with the strip on said roller and adapted to electrically engage with the strip on the said roller when the terminal end of the towel web is withdrawn from between the roller and member; and c. electrically connecting the respective strips in each cabinet with a separately identified indicator such that the indicator is energized by the electrical engagement of the respective strips in a given cabinet when a given towel web terminal end is withdrawn from between them and a particular cabinet is identified for replenishment of the toweling supply.

2. A system for indicating that the supply of toweling in one of a plurality of towel cabinets has been soiled and requires replacement comprising:

a. a plurality of cabinets having elongate toweling dispensing slotted openings from which towel webs may be dispensed, and return openings through which the webs may be returned to the cabinets, the webs normally depending from the cabinets in loops which are accessible to the hands of users;

b. a roller system having a clean toweling web wound thereon mounted within each of said cabinets for web unwinding rotary travel in which the web is dispensed out said slotted opening;

c. a used toweling wind-up roller mounted within each cabinet to receive the web from said roller system;

d. means for driving the wind-up roller in each cabinet in a direction to pull the soiled web through said return openings and wind them on the wind-up roller;

e. said roller system in each cabinet including an axially extending roller with an electrically conductive substantially peripherally continuous strip on its peripheral face curved to the configuration of said face and removed from the wind-up roller, and a second axially extending member, movably supported by each cabinet adjacent and axially paralleling each said roller system roller and normally biased to engage said strip, normally separated from said strip by the unwinding portion of said web, said member having a pair of electrically conductive strips fixed in axially co-planar relative reaction thereon in confronting relation with said strip on said roller system roller and adapted to electrically engage with said strip on the said roller system roller when the terminal end of the towel web is withdrawn from between said roller system roller and member;

f. and a multiple indicator system electrically connected with the respective strips in each cabinet energized by the electrical engagement of the respective strips in a given cabinet when a given towel web terminal end is withdrawn from between them, said indicator system having means adapted to connect to a power source and means for identifying which cabinet has strips in electrically conducting engagement.

3. The system of claim 2 wherein said indicating system comprises a bank of separate lamps, each of which is identified as associated with a particular cabinet.

4. The system of claim 2 wherein said strip on the roller system roller is annular, and a pair of axially electrically separated strips are provided on said member in confronting relation with the annular strip to provide a series circuit therewith when the web is withdrawn from between them.

5. The system of claim 2 wherein a take-up roller having a rough surfaced periphery, is provided adjacent the wind-up roller on which the soiled web is wound; and means is provided mounting the wind-up roller for vertical travel as the diameter of the soiled web on the wind-up roller increases.

6. A method of indicating which of a plurality of widely dispersed towel cabinets in a building have their clean toweling webs soiled and require clean towel roll replacement, the cabinets each having a used toweling wind-up roller within each cabinet for rewinding the soiled web therein, a roller system with a web supply thereon mounted within each of said cabinets for web unwinding travel, and means for driving the wind-up roller in each cabinet in a direction to rewind the web thereon, the roller system in each cabinet including an axially extending, electrically non-conductive roller remote from said wind-up roller and a second axially parallel member, mounted within each cabinet adjacent and axially parallel to each said roller system roller and normally biased to engage said strip, normally separated form the roller system roller by the web, comprising the steps of:

a. mounting an electrically conductive first strip on the peripheral face of the roller system roller curved to the configuration of the face;

b. mounting an electrically conductive strip curved generally to the configuration of said first strip on the said second member in confronting relation with the strip on said roller system roller and adapted to electrically engage with the strip on the said roller system roller when the terminal end of the towel web is withdrawn from between the said roller system roller and member; and c. electrically connecting the respective strips in each cabinet with a separately identified indicator such that the indicator is energized by the electrical engagement of the respective strips in a given cabinet when a given towel web terminal end is withdrawn from between the and a particular cabinet is identified for replenishment of the toweling supply.

7. A method of indicating that a towel cabinet in a building has its clean toweling web soiled and requires clean towel roll replacement, the cabinet having a used toweling wind-up roller within the cabinet for rewinding the soiled web thereon and means for moving the wind-up roller in a rewinding direction of travel, and a roller system mounted within the cabinet for web unwinding, rotary travel; the roller system including an axially extending roller parallel to the wind-up roller, and an axially extending member in said cabinet engaged by the web in its travel between said roller comprising the steps of:

a. providing an electrically conductive surface on said member remote from said wind-up roller;

b. providing an electrically conductive surface within the cabinet in confronting relation with the surface on said member biased to electrically engage with the surface on the said member when the terminal end of the towel web is withdrawn from a position of engagement with the member; and c. electrically connecting the respective surfaces with an indicator such that the indicator is energized by the electrical engagement of the respective surfaces when the towel web terminal end is withdrawn from engagement with said member and said cabinet is identified for replenishment of the clean toweling supply.

8. A towel cabinet indicating and identifying system for indicating that the supply of toweling in a cabinet has been soiled and requires replacement comprising:

a. a cabinet having an elongate toweling dispensing slotted opening from which a towel web may be dispensed, and a return opening through which the web may be returned to the cabinet, the web normally depending form the cabinet in a loop which is accessible to the hands of users;

b. a roller system mounted within said cabinet for rotary travel;

c. a used toweling wind-up roller within said cabinet for receiving the soiled web and means for moving the wind-up roller in a rewinding direction of travel;

d. said roller system including an axially extending supply roller from which the web is dispensed parallel to the wind-up roller;

e. an axially extending member in the cabinet engaged by the web in its travel between said rollers, said member having a first electrically conductive surface thereon remote from said wind-up roller;

f. a second electrically conductive surface mounted within said cabinet in confronting relation with the said surface on said member to electrically engage with the said surface on the member when the terminal end of the towel is withdrawn from a position of engagement with the member; and g. an indicator system electrically connected with the respective electrically conductive first and second surfaces in the cabinet energized by the electrical engagement of the respective first and second surfaces when a given towel web terminal end is withdrawn from between them, said indicator system having means adapted to connect to an electrical power source.

9. The system of claim 8 wherein said roller system includes a second axially extending roller and said second surface comprises a strip on its peripheral face.

* * * * *

UNITED STATES PATENT AND TRADEMARK OFFICE

CERTIFICATE OF CORRECTION

PATENT NO. : 4,999,611

DATED : March 12, 1991

INVENTOR(S) : William Zehnder, Jr.

It is certified that error appears in the above-identified patent and that said Letters Patent is hereby corrected as shown below:

Column 5, line 66, change "reaction" to -- relation --.

Column 6, line 61, change "the" to -- them --.

Column 7, line 5, change "roller" to -- rollers --; column 7, line 30, change "form" to -- from --.

Signed and Sealed this

Fourth Day of August, 1992

*Attest:*

DOUGLAS B. COMER

*Attesting Officer*

*Acting Commissioner of Patents and Trademarks*